US008920549B2

(12) United States Patent
Kim et al.

(10) Patent No.: US 8,920,549 B2
(45) Date of Patent: Dec. 30, 2014

(54) WET-TYPE DUST COLLECTOR FOR A VACUUM CLEANER

(75) Inventors: Min-Ha Kim, Gwangju-si (KR); Joung-Soo Park, Jeonju-si (KR); Heung-Jun Park, Gwangju-si (KR); Sung-Tae Joo, Gwangju-si (KR); Dong-Houn Yang, Gwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 146 days.

(21) Appl. No.: 13/392,381

(22) PCT Filed: Jun. 21, 2010

(86) PCT No.: PCT/KR2010/004009

§ 371 (c)(1),
(2), (4) Date: Feb. 24, 2012

(87) PCT Pub. No.: WO2011/025137

PCT Pub. Date: Mar. 3, 2011

(65) Prior Publication Data

US 2012/0167772 A1 Jul. 5, 2012

(30) Foreign Application Priority Data

Aug. 26, 2009 (KR) ..... 10-2009-0079416

(51) Int. Cl.

| | |
|---|---|
| ***B01D 47/00*** | (2006.01) |
| ***A47L 9/16*** | (2006.01) |
| ***A47L 9/18*** | (2006.01) |
| ***A47L 9/00*** | (2006.01) |

(52) U.S. Cl.

CPC ..... *A47L 9/182* (2013.01); *A47L 9/1666* (2013.01); *A47L 9/1625* (2013.01); *A47L 9/186* (2013.01); *A47L 9/0072* (2013.01)

USPC ..... 96/247; 96/329; 96/406

(58) Field of Classification Search

USPC ..... 95/24, 226

See application file for complete search history.

(56) References Cited

U.S. PATENT DOCUMENTS 5,032,155 A * 7/1991 Wiese et al. ..... 96/406

FOREIGN PATENT DOCUMENTS

| | | | |
|---|---|---|---|
| DE | 19807664 | A1 * | 9/1999 |
| EP | 2433540 | A2 * | 3/2012 |
| GB | 2438583 | A | 12/2007 |
| JP | 07-095943 | | 4/1995 |

(Continued)

OTHER PUBLICATIONS

Translation of KR20060101061.*

(Continued)

*Primary Examiner* — Duane Smith
*Assistant Examiner* — Phillip Shao
(74) *Attorney, Agent, or Firm* — Staas & Halsey LLP

(57) ABSTRACT

A wet-type dust collector for a vacuum cleaner. The disclosed wet-type dust collector includes a first separating portion, the inside of which is filled with water for separating dust from air that is suctioned in from the outside; an exhaust pipe unit having an exhaust outlet and installed inside the first separating portion; and a passage-closing unit installed inside the exhaust pipe unit, wherein the passage-closing unit closes the exhaust outlet of the exhaust pipe unit by means of the combined forces of the suctioning force through the exhaust pipe unit and the buoyant force of the water, in order to prevent the water from leaking out from the first separating portion.

10 Claims, 5 Drawing Sheets

(56) References Cited

FOREIGN PATENT DOCUMENTS

| | | | | |
|---|---|---|---|---|
| JP | 08-019495 | | 1/1996 | |
| JP | 2002-102124 | | 4/2002 | |
| KR | 10-2006-0101060 | | 9/2006 | |
| KR | 20060101061 | * | 9/2006 | ..... A47L 9/10 |
| WO | WO 92/12664 | | 8/1992 | |
| WO | WO 03/096864 | A1 | 11/2003 | |

OTHER PUBLICATIONS

Translation of DE19807664.*
Translation of EP2433540A2.*
Extended European Search Report mailed Jan. 21, 2013 for corresponding European Application No. 10812151.8.
International Search Report of PCT/KR2010/004009 mailed Feb. 24, 2011.

* cited by examiner

WET-TYPE DUST COLLECTOR FOR A VACUUM CLEANER

CROSS-REFERENCE TO RELATED APPLICATIONS

This application is a U.S. National Phase application of PCT/KR2010/004009 filed Jun. 21, 2010 and claims the priority benefit of Korean Application No. 10-2009-0079416 filed Aug. 26, 2009 in the Korean Intellectual Property Office, the contents of both of which are incorporated herein by reference.

BACKGROUND

1. Field

The invention relates to a wet-type dust collector for a vacuum cleaner which collects dust using water, and more particularly, to a wet-type dust collector for a vacuum cleaner which is capable of efficiently preventing leakage of water filled in the wet-type dust collector.

2. Description of the Related Art

Generally, a vacuum cleaner, which operates to separate dust using centrifugal force, and a wet-type dust collector with improved dust separating efficiency, filling an interior of a dust bin with water and collecting dust using the water, has been distributed.

A conventional wet-type dust collector may have an increasingly contaminated interior due to foreign matters combined with water when the water of the dust bin is discharged outside the wet-type dust collector through an exhaust outlet of the dust bin, possibly resulting in hygienic problems. Further, if the water leaks inside the vacuum cleaner and enters the fan motor unit, the interior of the fan motor unit may be corroded and moisture or water may overflow outside the vacuum cleaner.

Accordingly, various constructions have been suggested to prevent the leakage of the water of the dust bin of a wet-type dust collector into the vacuum cleaner.

One of such examples is disclosed in Japanese Patent Publication No. 2002-102124 ('Conventional art 1'), Japanese Patent No. 3291377 ('Conventional art 2'), and Korean Patent Publication No. 2006-0101060 ('Conventional art 3').

Conventional art 1 discloses a wet-type dust collector constructed such that a floater is provided inside a dust bin to close an exhaust outlet of a dust bin by rising in accordance with the rise of the water level.

Conventional art 2 discloses a vacuum cleaner in which a pre-filter with a floater accommodated in a fluid communicating port thereof is connected to a fan motor unit so that the floater closes the fluid communicating port as the level of water rises in the water tank.

Conventional art 3 discloses a wet-type dust collector in which a floater is arranged inside a filter installed at an exhaust outlet of a dust bin, to close the exhaust outlet by rising in response to the introduction of water into the filter.

As explained above, the conventional arts prevent the leakage of water into the vacuum cleaner by using a floater which floats on water and rises in accordance with the increasing water level as the water is over-charged in the dust bin or the like.

However, since the conventional arts are constructed to close the exhaust outlet of the dust bin by the floater which rises in accordance with the water level, reliability of preventing water leakage into the vacuum cleaner deteriorates. That is, if water shakes while the vacuum cleaner is driven, the floater alone cannot prevent the leakage of water through the exhaust outlet efficiently. Further, if water drops (droplets) are generated from the water, it is impossible to prevent leakage of such droplets in the exhausted air to outside of the wet-type dust collector.

Further, in conventional arts 2 and 3 in which the floater is arranged inside a vertical exhaust pipe of a centrifuging portion, the suction force at the upper portion of the exhaust pipe is directly transmitted to the surface of the water on which the floater is positioned. Accordingly, the water shakes can occur by the suction force on the surface of the water on which the floater is positioned. In this case, if the droplets are generated by the water shakes, it is impossible to prevent leakage of the generated droplets to outside of the wet type dust collector due to the suction force.

Further, although the water of the dust collecting device such as dust bin or water tank is at such a level that does not cause the floater to close the exhaust outlet, at high water level, water can be discharged out of the wet-type dust collector due to suction force generated in the driving of the vacuum cleaner, and leaked into the vacuum cleaner.

In order to overcome the above-mentioned problems in the conventional arts, an object of the following disclosure is to provide a wet-type dust collector for use in a vacuum cleaner which is capable of efficiently preventing leakage of water filled in the wet-type dust collector.

Further, another object of the invention is to provide a wet-type dust collector for use in a vacuum cleaner in which shaking of water filling in the wet-type dust collector due to suction force during operation of the vacuum cleaner, or leakage of the water along an exhaust pipe unit in a slip stream of the dust collector, is prevented.

SUMMARY

Additional aspects and/or advantages will be set forth in part in the description which follows and, in part, will be apparent from the description, or may be learned by practice of the invention.

In order to achieve the above-mentioned objects, a wet-type dust collector includes: a first separating portion, the inside of which is filled with water for separating dust from air that is suctioned in from the outside; an exhaust pipe unit having an exhaust outlet and installed inside the first separating portion; and a passage-closing unit installed inside the exhaust pipe unit, wherein the passage-closing unit closes the exhaust outlet of the exhaust pipe unit by means of the combined forces of the suctioning force through the exhaust pipe unit and the buoyant force of the water, in order to prevent the water from leaking out from the first separating portion.

The passage-closing unit may include a closing plate mounted inside the grill to be moveable upward and downward, a floater installed inside the exhaust pipe unit, and a closing plate support rod which connects the floater and the closing plate.

A rod insertion hole may be formed in the floater, and the closing plate support rod may be inserted into the rod insertion hole to be moveable upward and downward.

The closing plate support rod may include a length so that a lower end is not separated from the rod insertion hole when the closing plate closes the exhaust outlet of the exhaust pipe unit.

When the water level is above a normal level, but not at a location to allow the closing plate to close the exhaust outlet, the closing plate may be raised by the suction force of the vacuum cleaner to close the exhaust outlet when the vacuum cleaner is driven.

The passage-closing unit may be constructed to close the exhaust outlet of the exhaust pipe unit by the suction force transmitted through the exhaust pipe unit, if the water level is above a normal level.

The exhaust pipe unit may additionally include a locking jaw positioned on a lower portion of the grill to restrict upward and downward movement of the passage-closing unit; and a plurality of water inlets pierced through the exhaust pipe unit, and may be installed in the first separating portion in such a manner that an upper end of the exhaust pipe unit is in fluid communication with outside, and a lower end is submerged in water filled in the wet-type dust collecting region.

The wet-type dust collector may additionally include a second separating portion to separate dust particles entrained in air discharged from the first separating portion with water filled inside.

The second separating portion may additionally include a plurality of second introducing pipe units formed on a side surface of the first separating portion.

In order to achieve the above-mentioned objects, a wet-type dust collector includes: a first separating portion, filled with water, to separate dust from air that is suctioned in from outside; an exhaust pipe unit having an exhaust outlet and installed inside the first separating portion to pass air; and a passage-closing unit installed inside the exhaust pipe unit to prevent the ingress of water, wherein the passage-closing unit comprises a closing plate mounted inside a grill to be moveable upward and downward to prevent the ingress of water, based on a combined suction force.

In order to achieve the above-mentioned objects, a wet-type dust collector may also include an apparatus to prevent water leakage, including: an inlet to pass external air into the apparatus by suctioning; a first separating portion, filled with water, to separate dust from the external air; an exhaust pipe unit having an exhaust outlet and installed inside the first separating portion to pass air out of the apparatus; and a passage-closing unit installed inside the exhaust pipe unit to prevent the ingress of water, wherein the passage-closing unit comprises a closing plate mounted inside a grill to be moveable upward and downward to prevent the ingress of water, based on a combined suction force.

According to the present disclosure described above, if the level of the water filled in the wet-type dust collector exceeds a predetermined level, since the closing plate closes the exhaust pipe unit, water leakage to outside is prevented.

Further, according to the present disclosure, since the closing plate in normal water level closes the closing plate support rod moving hole formed in the lower portion of the grill of the exhaust pipe unit, transmission of suction force through the exhaust pipe unit is blocked, and as a result, water shaking due to suction force or rising through the exhaust pipe unit and leaking outside are prevented.

Further, according to the present invention, even when the closing plate is at high water level that does not close the exhaust pipe unit, since the closing plate is risen by the suction force to close the exhaust pipe unit as the vacuum cleaner is driven to generate suction force, water leakage to outside is prevented.

BRIEF DESCRIPTION OF THE DRAWINGS

The above features and/or other aspects and advantages will become apparent and more readily appreciated from the following description of the embodiments taken in conjunction with the accompanying drawings in which.

DETAILED DESCRIPTION

Figure 1:
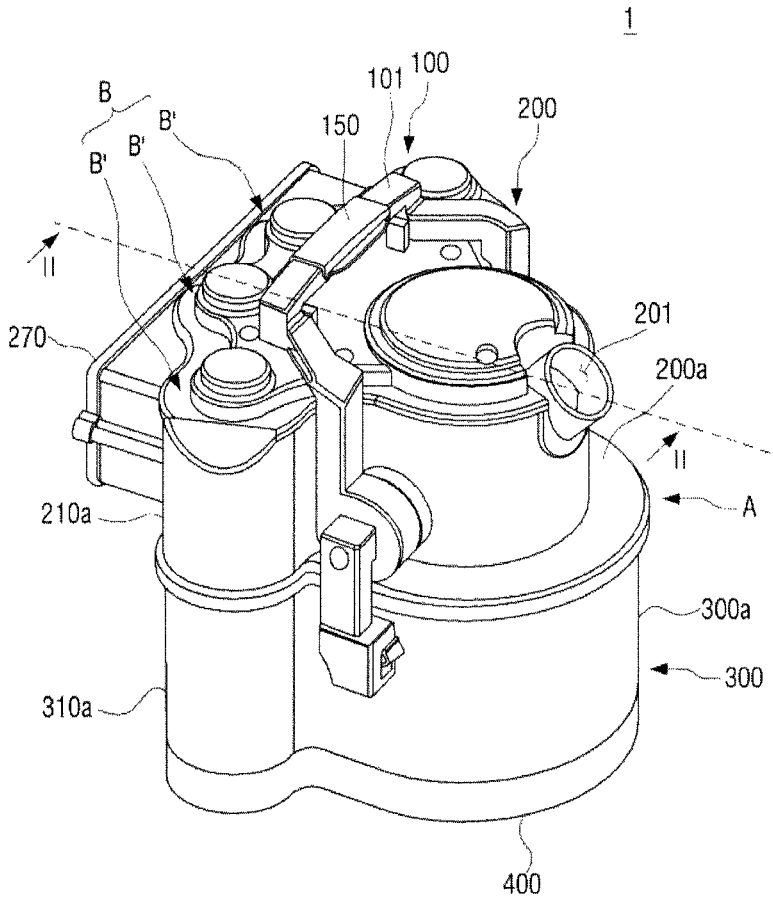
FIG. 1 is a perspective view of a wet-type dust collector 1, according to an example embodiment.

Reference will now be made in detail to the embodiments, examples of which are illustrated in the accompanying drawings, wherein like reference numerals refer to the like elements throughout. The embodiments are described below to explain the present disclosure by referring to the figures.

Figure 2:
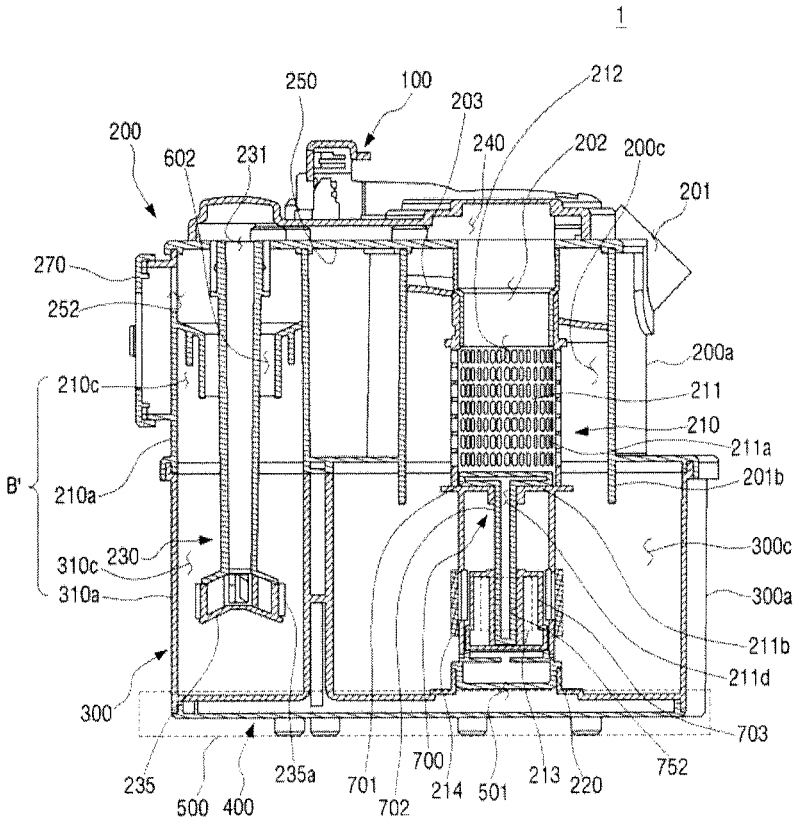
FIG. 2 is a cross-section view of the wet-type dust collector 1 taken along line II-II of FIG. 1.

FIG. 1 is a perspective view of a wet-type dust collector according to an embodiment, and FIG. 2 is a cross-section view taken along line II-II of FIG. 1.

The wet-type dust collector 1 includes a centrifugal separating assembly 200 and a dust bin unit 300.

The centrifugal separating assembly 200 (referring to FIG. 2) includes a handle unit 100, a first inlet 201, an exhaust chamber 270, a partitioning wall 250 which defines a second passage 240 at an upper portion of the dust bin unit 300, a first centrifugal separating region **200*c* at a lower portion, and a plurality of second centrifugal separating regions 210*c*, a first centrifugal separating pipe 200*a*, a first exhaust pipe unit 210, a passage-closing unit 700, a plurality of second centrifugal separating pipes 210*a* in fluid communication with the exhaust chamber 270, and a plurality of second introducing pipe units 230**.

The handle unit 100 is formed on the centrifugal separating assembly 200 and constructed for carrying of the centrifugal separating assembly 200, or to fix or separate the centrifugal separating assembly 200 to or from the dust bin unit 300. If the handle unit 100 is in a position to firmly fix the connection between the centrifugal separating assembly 200 and the dust bin unit 300, a grip portion 101 is fixed in position so as not to be rotated by a holder 150.

The first inlet 201 is formed on a side surface of the centrifugal separating assembly 200 to pass the external air from a brush assembly (not illustrated) of the like of the vacuum cleaner into the first centrifugal separating region **200*c***.

The exhaust chamber 270 is formed such that the second exhaust outlets 252 are all placed inside on one side surface of the centrifugal separating assembly 200 which the second exhaust outlets 252 exhausting air from the second centrifugal separating pipes **210*a* are formed. According to the construction explained above, the exhaust chamber 270 combines the exhaust air from the second exhaust outlets 252** and exhausts the air to a fan motor unit (not illustrated) of the vacuum cleaner (not illustrated).

The partitioning wall 250 includes, formed on a lower surface thereof, a first exhaust outlet 202 in fluid communication with the first exhaust pipe unit 210 and a plurality of second inlets 231 in fluid communication with the plurality of second introducing pipe units 230. The partitioning wall 250 is placed transversely on an inner side of the upper portion of the centrifugal separating assembly 200 to separate the area of the centrifugal separating assembly 200 into the second passage 240 at the upper portion and the first centrifugal separating region 200*c* at the lower portion, and the plurality of second centrifugal separating regions 210*c*. The second passage 240 formed by the partitioning wall 250 passes the air exhausted from the first exhaust outlet 202 to the plurality of second centrifugal separating regions 210*c* through the plurality of second inlets 231 and the second introducing pipe units 230.

The first centrifugal separating pipe 200*a* defines the first centrifugal separating region 200*c* at which larger and heavier dust particles are separated from the external air introduced through the first inlet 201. The first centrifugal separating pipe 200*a* may be formed into various shapes to have rectangular, trapezoidal or inverted trapezoidal cross-section.

The first centrifugal separating pipe 200*a* with the above-explained structure is installed on a lower surface of the partitioning wall 250 so that the upper portion is kept in fluid communication with the first exhaust outlet 202.

The first exhaust pipe unit 210 is an embodiment of the exhaust pipe unit according to the prevent disclosure, which is formed as a cylindrical pipe that includes a guide 203, a grill 211 and a sealing member 220.

The guide 203 protrudes in a spiral pattern on the upper and outer circumferential surface of the first exhaust pipe unit 210 to induce rotation of the introduced air.

Figure 3:
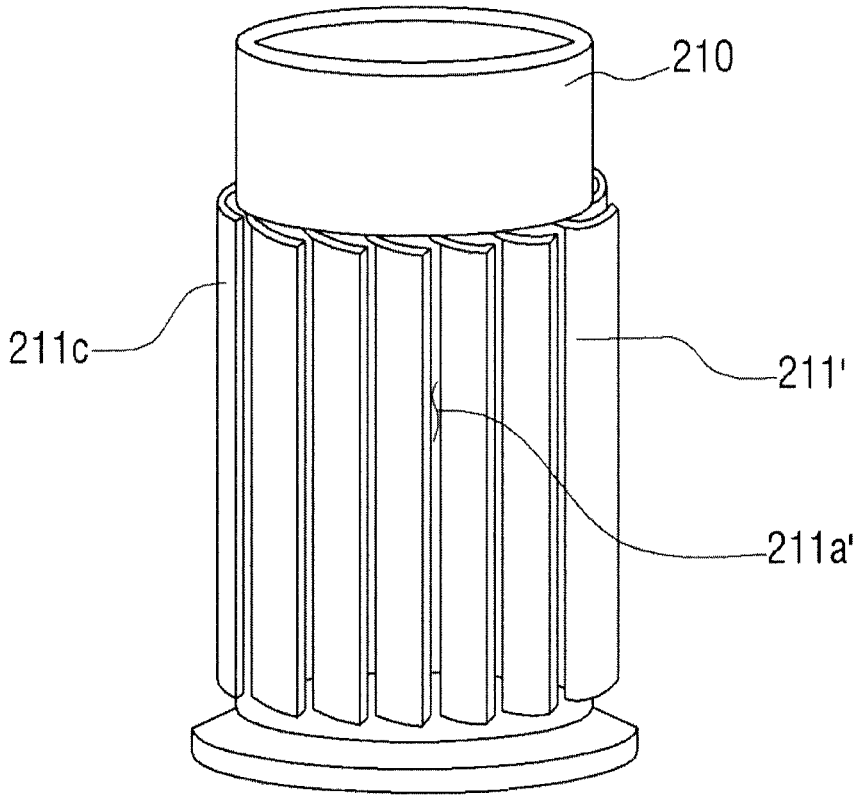
FIG. 3 is a front view of a grill 211', according to a modified embodiment.

The grill 211 has a structure in which a plurality of exhaust holes 211*a* are formed to filter out foreign matters entrained in the air exhausted through the first exhaust pipe unit 210. The grill 211 is formed at a center portion of the first exhaust pipe unit 210. The upper area of the grill 211 becomes the exhaust outlet 212, while the lower area thereof becomes the closing plate support rod moving hole 211*d*. FIG. 3 is a front view of the grill 211' according to a modified embodiment, in which the grill 211' has a plurality of grill ribs 211*c* protruding from the circumferential surface at a predetermined angle to form the exhaust outlets 211*a'*.

The sealing member 220 is attached to a lower surface of the first exhaust pipe unit 210.

Further, on an inner circumferential surface of the first exhaust pipe unit 210 that forms the lower surface of the grill 211, a locking jaw 211*b* extends to the direction of center so that the central portion forms the closing plate support rod moving hole 211*d*.

The first exhaust pipe unit 210 with the above-explained structure is connected to the centrifugal separating assembly 200 by being attached to the lower surface of the partitioning wall 250 in a fluid communication with the second passage 240 through the first exhaust outlet 202 inside the first centrifugal separating pipe 200*a*.

As the centrifugal separating assembly 200 with the first exhaust pipe unit 210 connected thereto is connected to the dust bin unit 300, the sealing member 220 is engaged with a water distributing hole 501 of the water distributing passage portion 500. Accordingly, the water distributing passage portion 500 and the first wet-type dust collecting region 300*c* are isolated from each other due to the presence of the sealing member 220.

The passage-closing unit 700 is installed inside the first exhaust pipe unit 210 to prevent the ingress of water W into the vacuum cleaner (not illustrated) through the first exhaust pipe unit 210.

The passage-closing unit 700 includes a closing plate 701, a floater 703 and a closing plate support rod 702 which connects the closing plate 701 with the floater 703.

The closing plate 701 is formed into a shape corresponding to the cross-section of the inner circumference of the first exhaust pipe unit 210 to seal off the internal passage of the grill and the exhaust outlet 212. The closing plate 701 is moveable upward and downward inside the grill 211.

The floater 703 is installed inside the first exhaust pipe unit 210 at which the water introducing hole 213 is formed. On an outer circumferential surface of the lower end of the first exhaust pipe unit 210 at which the water introducing hole 213 is formed, a net 214 in a mesh structure is attached to prevent ingress of relatively larger particles of foreign matters through the plurality of water introducing holes 213. The floater 703 is moveable upward and downward due to the buoyant force of the water W filling in the first dust bin 300*a*.

Figure 4:
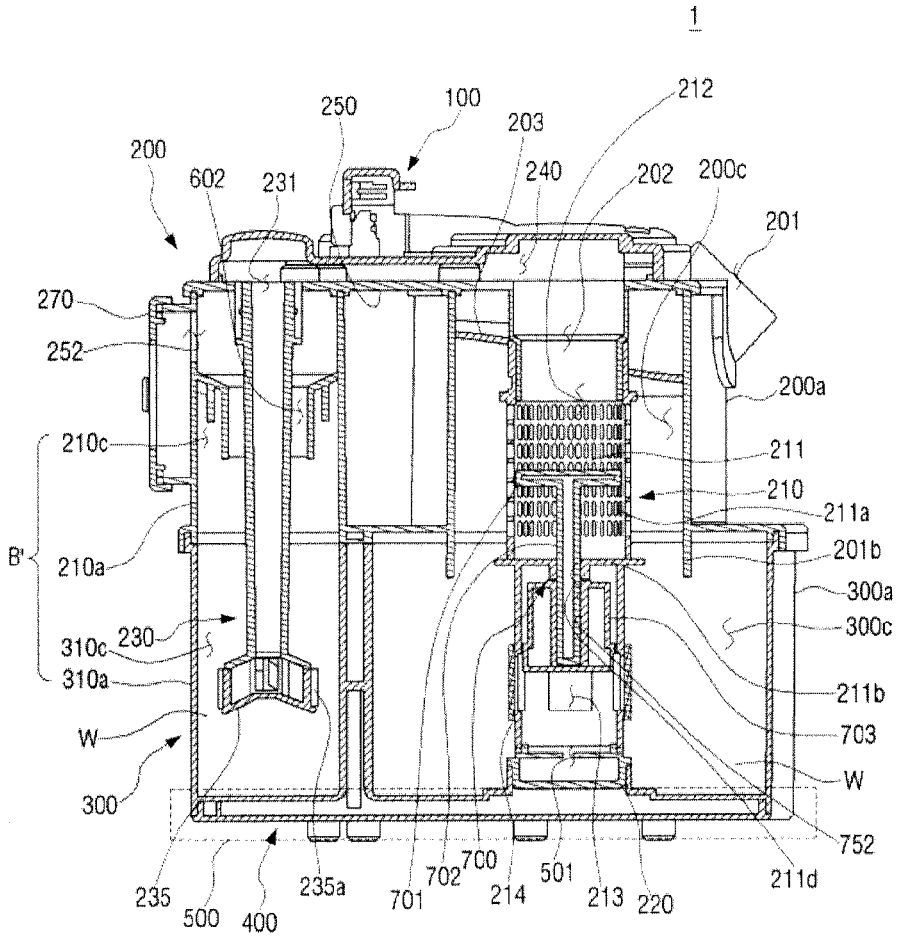
FIG. 4 is a cross-section view taken along line II-II of the wet-type dust collector 1 of FIG. 1, illustrating water filling up to the level that causes a closing plate 701 to be positioned between the exhaust outlet 212 and a closing plate support rod moving hole **211*d*.

The closing plate support rod 702 is inserted into a rod insertion hole 752 of the floater 703 to be moveable upward and downward. When the cleaner is not in operation or the water level is low so that the closing plate is in a low position as illustrated in FIG. 2 ('normal, or below normal water level'), bottom of the closing plate support rod 702 is brought into contact with the lower surface of the rod insertion hole 752 of the floater due to the self gravity of the closing plate support rod 702. Then as the closing plate 701 rises to above the central portion of the grill 211 as illustrated in FIG. 4 ('above normal water level') and the cleaner is operated, the closing plate 701 and the closing plate support rod 702 are lifted due to the suction force to the state illustrated in FIG. 5. (This will be explained in greater detail below.)

Further, the closing plate support rod 702 has a predetermined length so that the floater 703 and the closing plate 701 are moved upward and downward at a predetermined distance from each other. The length of the closing plate support rod 702 is kept within a range that does not allow separation of the closing plate 701 from the rod insertion hole 752 when in a state of closing the exhaust outlet 212. That is, the closing plate support rod 702 has the length such that, when the closing plate 701 is drawn out of the floater 703 and extended due to the suction force, the lower end does not separate from the rod insertion hole 752 irrespective of where the floater 703 is located. Further, the closing plate support rod 702 may have varying length depending on the height, width and degree of suction force of the first dust bin 300*a*, and has an optimum length that is confirmed through experiments as not causing water overflow.

Due to the distance between the floater 703 and the closing plate 701, i.e., due to the closing plate support rod 702, unlike the prior art, even when the water level of the first dust bin does not enable the floater 703 to seal off the exhaust outlet 212, water overflow or leakage through the exhaust outlet 212 can be effectively prevented due to the presence of the closing plate 701.

The plurality of second centrifugal separating pipes 210*a* each has a cylindrical shape. On an upper surface of the second centrifugal separating pipes 210*a* is formed a second exhaust outlet 252 in fluid communication with the exhaust chamber 270. Further, the plurality of second centrifugal separating pipes 210*a* has an inner diameter smaller than that of the first centrifugal separating pipe 200*a* to filter out minute dusts that are not removed in the first centrifugal separating pipe 200*a*.

Each of the second centrifugal separating pipes 210*a* with the above-explained structure is engaged with the lower surface of the partitioning wall 250, to accommodate therein the second inlets 231. When engaged as explained above, the second centrifugal separating pipes 210*a* define the second centrifugal separating regions 210*c*.

The plurality of second centrifugal separating pipes 210*a* are arranged on a side surface of the first centrifugal separating pipe 200*a*, in parallel, and integrated by the fluid communication with each other through the second passage 240.

The second introducing pipe unit 230 is formed in the shape of a cylindrical pipe with upper and lower open portions. On the lower end area of the second introducing pipe unit 230, an impeller 235*a* is formed. The impeller 235*a* has a plurality of passing holes and an impeller rib 235*a* bent at a predetermined angle. The second introducing pipe unit 230 is connected to a lower surface of the partitioning wall 250 to be in fluid communication with the second passage 240 through the second inlet 231 inside each of the second centrifugal separating regions 210*c*. The impeller 235 is submerged in water W in the second centrifugal separating regions 210*c*. The impeller 235 causes the air discharged through the second introducing pipe unit 230 to be discharged in a circular motion around the second introducing pipe unit 230. Accordingly, the air of the second centrifugal separating regions 210*c* and the water W of the second wet-type dust collecting region 310*c* are rotated.

The dust bin unit 300 (see FIG. 2) includes a first dust bin 300*a*, a plurality of second dust bins 310*a*, and a lower cover 400 which defines a water distributing passage portion 500 to connect lower portions of the first dust bin 300*a* and the second dust bins 310*a* in a fluid communication with each other.

The first dust bin 300*a* defines a first wet-type dust collecting region 300*c* at which dust is collected due to the rotating water W. The first dust bin 300*a* may have a variety of cross-sections including rectangle, trapezoid or inverted trapezoid.

The second dust bins 310*a* define the plurality of second wet-type dust collecting regions 310*c* to collect minute dust with the rotating water W. The second dust bins 310*a* defining the second wet-type dust collecting regions 310*c* are formed in parallel along the side surface of the first dust bin 300*a* at a location that corresponds to the lower surface of the second centrifugal separating pipes 210*a*.

The first wet-type dust collecting region 300*c* and the plurality of second wet-type dust collecting regions 310*c* are connected in fluid communication with each other at lower portions thereof, so that it is possible to fill the water W concurrently.

As the centrifugal separating assembly 200 with the structure explained above is connected to the upper portion of the dust bin unit 300, the wet-type dust collector 1 is constructed.

If the centrifugal separating assembly 200 is connected to the upper portion of the dust bin unit 300, the first centrifugal separating pipe 200*a* is inserted into the first dust bin 300*a*. At this time, the sealing member 220 is engaged with the water distributing hole 501 to isolate the water distributing passage portion 500 from the first wet-type dust collecting region 300*c*.

If the centrifugal separating assembly 200 is engaged with the dust bin unit 300, the second introducing pipe units 230 are also inserted into the corresponding second centrifugal separating pipes 210*a*, respectively.

If the centrifugal separating assembly 200 is engaged with the dust bin unit 300, the first centrifugal separating pipe 200*a* and the first dust bin 300*a* are engaged with each other, to form a first separating portion A.

The second centrifugal separating pipes 210*a* and the second dust bins 310*a* form second centrifugal separating portions B', respectively. The second centrifugal separating portions B' with the structure explained above, separate minute dust particles which are not removed in the first separating portion A. All the second centrifugal separating portions B' form a second separating portion B at which minute dust particles, which are not removed at the first separating portion A, are separated.

In the construction explained above, the centrifugal separating assembly 200 and the dust bin unit 300 may be constructed only with the first centrifugal separating pipes 200*a* and the first dust bins 300*a*, i.e., without requiring the second centrifugal separating pipes and the second dust bins 210*a*, 310*a*. In such a case, a combined form of the first centrifugal separating pipes 200*a* and the plurality of second centrifugal separating pipes 210*a*, or the first centrifugal separating pipes 200*a* may become the centrifugal separating pipe according to the present invention. Alternatively, the combined form of the first dust bins 300*a* and the second dust bins 310*a*, or the first dust bins 300*a* alone may become the dust bin unit of the present invention.

When the wet-type dust collector 1, connected in the manner explained above, is mounted in the vacuum cleaner (not illustrated), the exhaust chamber 270 is connected to a passage which is in fluid communication with the fan motor unit (not illustrated) of the vacuum cleaner (not illustrated). Further, the first inlet 201 is connected to an introducing passage (not illustrated) connected to a component such as brush assembly (not illustrated). As a result, the wet-type dust collector 1 forms the passage for the air current inside the vacuum cleaner (not illustrated).

When the vacuum cleaner is driven in the assembled state explained above, externally-drawn air is introduced into the first centrifugal separating regions 200*c* through the first inlet 201.

The air introduced into the first centrifugal separating regions 200*c* rotates around the first exhaust pipe unit 210. As the air rotates around the first exhaust pipe unit 210, due to the rotational force of the air, water W in the first wet-type dust collecting regions 300*c* of the first dust bins 300*a* also rotates. As a result, foreign matter are separated by the centrifugal force in the first centrifugal separating regions 200*c*, and the separated foreign matters are collected by the rotating water W in the first wet-type dust collecting regions 300*c*.

After the foreign matters are separated due to the centrifugal force from the rotating air and also by the rotating water W at the first separating portion A, the air is introduced into the second passage 240 via the grill 211 and the first exhaust pipe unit 210.

The air introduced into the second passage 240 is passed through the plurality of second inlets 231 formed in the partitioning wall 250, and the second centrifugal separating pipes 210*a* in fluid communication with the second inlets 231, and then introduced into the second wet-type dust collecting regions 310*c*. As the air is introduced into the second wet-type dust collecting regions 310*c*, the air is rotated in a predetermine direction and discharged by the impeller 235*a*. Accordingly, water W in the second wet-type dust collecting regions 310*c* rotates. Since the water W rotates in the second wet-type dust collecting regions 310*c*, dust is collected due to the surface tension or polarity thereof, while centrifugal force is applied to the minute dust particles entrained in the air discharged into the water W. Accordingly, efficiency of separating and collecting minute dust particles increases.

After minute dust particles are separated due to the water W in the second wet-type dust collecting regions 310*c*, the air moves upward, passed through the second exhaust passage 602 formed between the second centrifugal separating pipes 210*a* and the second introducing pipe unit 230, and discharged into the exhaust chamber 270.

In the vacuum cleaner operating in the manner explained above, the passage-closing unit 700 prevents leakage of the water W from the dust bin unit 300 to the outside.

Figure 5:
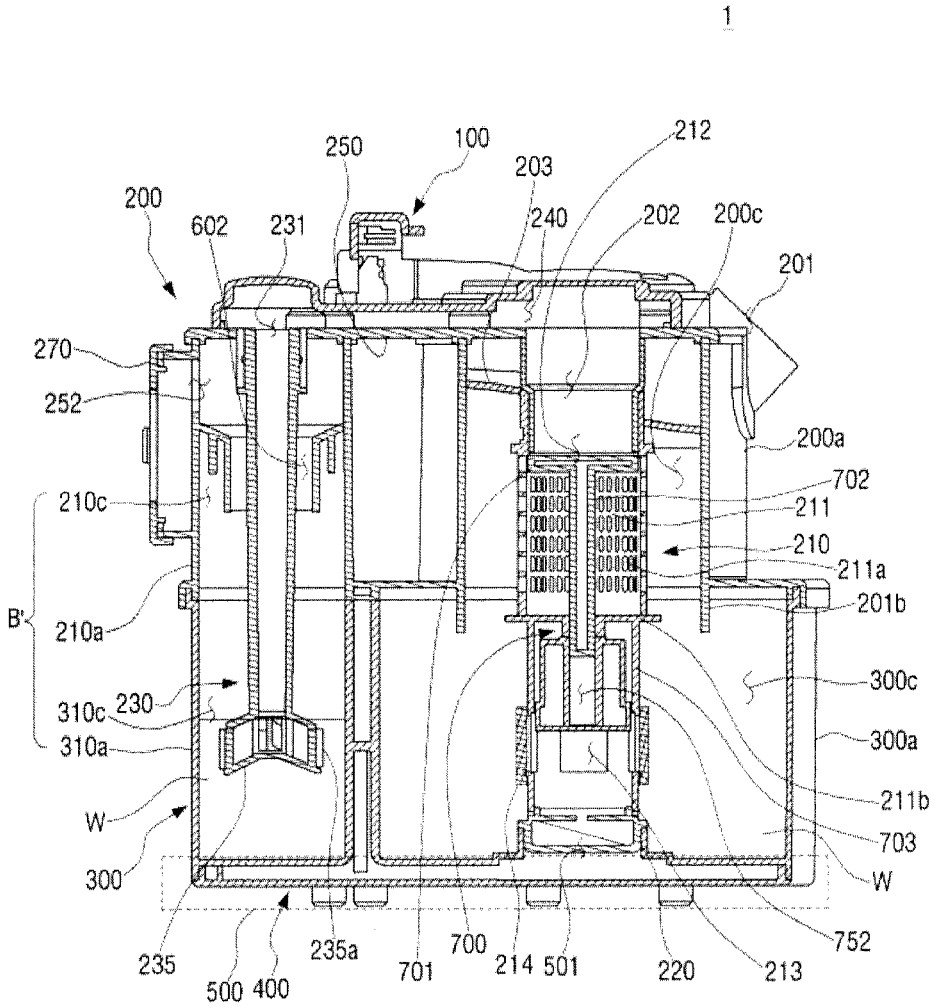
FIG. 5 is a cross-section view taken along line II-II of the wet-type dust collector 1 of FIG. 1, illustrating a state in which the closing plate 701 closes the exhaust outlet 212**.

FIG. 4 illustrates water filling up to the level that causes a closing plate 701 of FIG. 2 to be positioned between the exhaust outlet 212 and the closing plate support rod moving hole 211*d*, and FIG. 5 illustrates a state in which the closing plate 701 closes the exhaust outlet 212.

Referring to FIGS. 2, 4 and 5, the operation of the passage-closing unit 700 will be explained in greater detail. The passage-closing unit 700 is seated on the upper portion of the locking jaw 211*b*, if the water W level is so low that the closing plate 701 is seated on the upper surface of the locking jaw 211*b* (see FIG. 2).

In such a situation, the normal operation of the wet-type dust collector is performed, in which the suction force is transmitted via the exhaust outlet 212 and the grill 211 to the first wet-type dust collecting regions 300*c*, and the externally-drawn air through the first inlet 201 is separated in the first centrifugal separating pipes 200*a* and the first wet-type dust collecting regions 300*c*, and discharged through the grill 211 and the exhaust outlet 212.

Referring to FIG. 4, if the water level is at about middle area of the first centrifugal separating regions 200*c*, the floater 703 moves upward due to the buoyant force of the water, and the closing plate connected thereto is placed at about the middle area of the grill. At this situation, the closing plate 701 does not close the exhaust outlet 212. However, since the closing plate 701 is in proximity to the exhaust outlet 212 according to the water level, the closing plate 701 rises as shown in FIG. 5 as the suction force is transmitted through the exhaust outlet 212 to thereby close the exhaust outlet 212. That is, even when the level of water W in the first dust bins 300*a* is lower than the location that enables the closing plate 701 to close the exhaust outlet 212, if the closing plate is at a location above the middle area of the grill, the suction force transmitted through the exhaust outlet 212 can directly move the closing plate 701 upwardly to close the exhaust outlet 212 as the vacuum cleaner (not illustrated) is driven.

The water can shake due to the suction force even when the water is filled up to the height as illustrated in FIG. 4, and the droplets due to the shaking air may be entrained in the air to leak out through the exhaust outlet. However, the path closing unit constructed according to the present invention prevents leakage of the internal water W of the dust bin unit 300 to outside efficiently.

Although not explained, the reference numeral 201*b* refers to a backflow preventive rib to prevent backward flow of the water, through the grill 211 when the water shakes in the first wet-type dust collecting regions 300*c*.

The wet-type dust collector 1 with the constitution and function explained above operates as a dry-type dust collector if water W is not filled.

The above disclosure can be applied in cleaning apparatuses, such as, domestic, commercial, and industrial cleaners.

Although a few embodiments have been shown and described, it would be appreciated by those skilled in the art that changes may be made in these embodiments without departing from the principles and spirit of the invention, the scope of which is defined in the claims and their equivalents.

The invention claimed is:

1. A wet-type dust collector, comprising:

a first separating portion, the inside of which is filled with water, for separating dust from air that is suctioned in from the outside;

an exhaust pipe unit having an exhaust outlet and installed inside the first separating portion; and a passage-closing unit installed inside the exhaust pipe unit in order to prevent the water from leaking out from the first separating portion, wherein the passage-closing unit comprises:

a floater which is installed inside the exhaust pipe unit and moves by a buoyant force of the water; and a member which is detachably connected to the floater and closes the exhaust outlet of the exhaust pipe unit by a suctioning force through the exhaust pipe unit.

2. The wet-type dust collector of claim 1, wherein the member comprises:

a closing plate mounted inside a grill to be moveable upward and downward; and a closing plate support rod which is connected to both the floater and the closing plate.

3. The wet-type dust collector of claim 2, wherein a rod insertion hole is formed in the floater, and the closing plate support rod is inserted into the rod insertion hole to be moveable upward and downward.

4. The wet-type dust collector of claim 3, wherein the closing plate support rod has a length so that a lower end is not separated from the rod insertion hole when the closing plate closes the exhaust outlet of the exhaust pipe unit.

5. The wet-type dust collector of claim 2, wherein, when the water level is above a predetermined level, but not at a location to allow the closing plate to close the exhaust outlet, the closing plate is configured to rise by the suction force of the vacuum cleaner to close the exhaust outlet when the vacuum cleaner is driven.

6. The wet-type dust collector of claim 1, wherein the passage-closing unit is constructed to close the exhaust outlet of the exhaust pipe unit by the suction force transmitted through the exhaust pipe unit, when the water level is above a predetermined level.

7. The wet-type dust collector of claim 1, wherein the exhaust pipe unit further comprises a locking jaw positioned on a lower portion of a grill to restrict upward and downward movement of the passage-closing unit, and a plurality of water inlets pierced through the exhaust pipe unit, and wherein the exhaust pipe unit is installed in the first separating portion, such that an upper end of the exhaust pipe unit is in fluid communication with outside, and a lower end is submerged in water filled in the wet-type dust collecting region.

8. The wet-type dust collector of claim 1, further comprising a second separating portion to separate dust particles entrained in air discharged from the first separating portion with water filled inside.

9. The wet-type dust collector of claim 8, wherein the second separating portion further comprises a second introducing pipe unit to rotate the introduced air, and the plurality of second introducing pipe unit is installed on a side surface of the first separating portion.

10. The wet-type dust collector of claim 1, wherein the floater is moved upwards or downwards by a buoyant force of the water, and the member is moved by the floater.

* * * * *